US005911879A

United States Patent [19]

Eybergen

[11] Patent Number: 5,911,879

[45] Date of Patent: Jun. 15, 1999

[54] REFRIGERANT FILTER/DRIER

[75] Inventor: William N. Eybergen, Windsor, Canada

[73] Assignee: Eaton Corporation, Cleveland, Ohio

[21] Appl. No.: 08/936,793

[22] Filed: Sep. 24, 1997

[51] Int. Cl.[6] ..... B01B 27/08; F25B 43/00

[52] U.S. Cl. ..... 210/282; 210/205; 210/304; 210/443; 210/484; 210/DIG. 6; 55/323; 55/331; 55/482; 62/474; 96/137

[58] Field of Search ..... 55/316, 323, 331, 55/337, 485, 482, 502; 210/282, 446, 443, 484, DIG. 6, 304; 96/137; 62/474

[56] References Cited

U.S. PATENT DOCUMENTS

| | | | |
|---|---|---|---|
| 3,815,752 | 6/1974 | Hoffman et al. | 210/266 |
| 3,841,490 | 10/1974 | Hoffman et al. | 210/266 |
| 4,364,756 | 12/1982 | Clarke et al. | 55/316 |
| 4,436,623 | 3/1984 | Cullen et al. | 210/282 |
| 4,811,571 | 3/1989 | Mayer | 210/DIG. 6 |
| 4,908,132 | 3/1990 | Koval et al. | 210/446 |
| 5,440,898 | 8/1995 | Starr | 210/446 |

*Primary Examiner*—David A. Reifsnyder
*Attorney, Agent, or Firm*—Roger A. Johnson

[57] ABSTRACT

A filter/drier for receiving and discharging a flow of refrigerant having a header with an inlet passage forming a plenum and an outlet passage through the header. A louvered baffle plate has peripheral tabs crimped over an annular flange on the header to form a subassembly. A cup-shaped shell containing desiccant, with a layer of fibrous filter material over the desiccant, is assembled over the header subassembly and sealed to the header by weldment. The peripheral spaces between the crimped baffle tabs provide exclusive flow dispersion to an annular collector space in the header which communicates with the outlet passage.

14 Claims, 2 Drawing Sheets

REFRIGERANT FILTER/DRIER

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to a filter/drier assembly for trapping foreign particles and removing moisture from refrigerant circulated in a vapor-liquid phase refrigeration system. Devices of this type are commonly employed in motor vehicle passenger compartment air conditioning systems to maintain the efficiency of the heat transfer capability of the refrigerant and to prevent moisture and foreign particles from entering the refrigerant compressor and reducing the service life of the compressor.

A commonly employed filter/drier for automotive air conditioning system installations is shown in FIG. 1 and has an inlet fitting 1 attached to a cup-shaped housing shell 2 which has disposed therein a louvered baffle plate 3 which forms a plenum 4 adjacent the inlet fitting. A layer of fibrous filter material 5 is disposed adjacent the baffle plate 3.

The central region of the shell 2 is filled with desiccant material 6 covered by a second filter layer 7 and retained in the shell by a second louvered baffle plate 8. The shell is closed by a cap 9 secured to the shell by weldment. An outlet fitting 10 is attached to the cap 9 typically by weldment. The prior art device of FIG. 1 is thus a flow-through type filter/drier intended for in-line installation in a refrigeration system. The prior art filter/drier of FIG. 1 has the disadvantage that it is difficult to assemble by virtue of the requirement to install the two baffles in the shell for retaining the desiccant and the attachment of separate fittings to the relatively thin shell and cap. In particular, it has proven difficult to provide a fluid pressure tight seal of the weldment of the cap to the shell in view of the thinness of the shell and cap material for the desired lightweight construction. It has thus been desired to provide an improved filter/drier for a refrigerant system which is easy to assemble, light in weight, with a reduced number of components and joining operations and is low in manufacturing cost.

BRIEF SUMMARY OF THE INVENTION

The present invention provides a unique filter/drier for receiving and discharging refrigerant flow and providing for filtering of moisture and foreign particles in the refrigerant.

It is an object of the present invention to provide a filter/drier for receiving and discharging refrigerant and which has a minimum number of parts and is easy to assemble and low in manufacturing costs.

It is a further object of the invention to provide an improved refrigerant filter/drier which is particularly suitable for use in high volume production automotive air conditioning systems.

The filter/drier of the present invention has a header with an inlet passage defining a plenum and a separate outlet passage therethrough. A baffle for baffling flow from the inlet plenum is attached to the header forming a subassembly. Portions of the baffle define a plurality of flow dispersion passages for exclusively communicating flow with the outlet passage in the header. A cup-shaped shell with desiccant therein is then assembled over the subassembly and secured to the header conveniently by weldment thereto with the mass of the header absorbing the heat from the weld without damage to the desiccant. In the preferred practice, the baffle is formed of a louvered plate with tabs or projections provided peripherally thereon which are crimped over the header to form the dispersion passages.

DETAILED DESCRIPTION OF THE INVENTION

Figure 2:
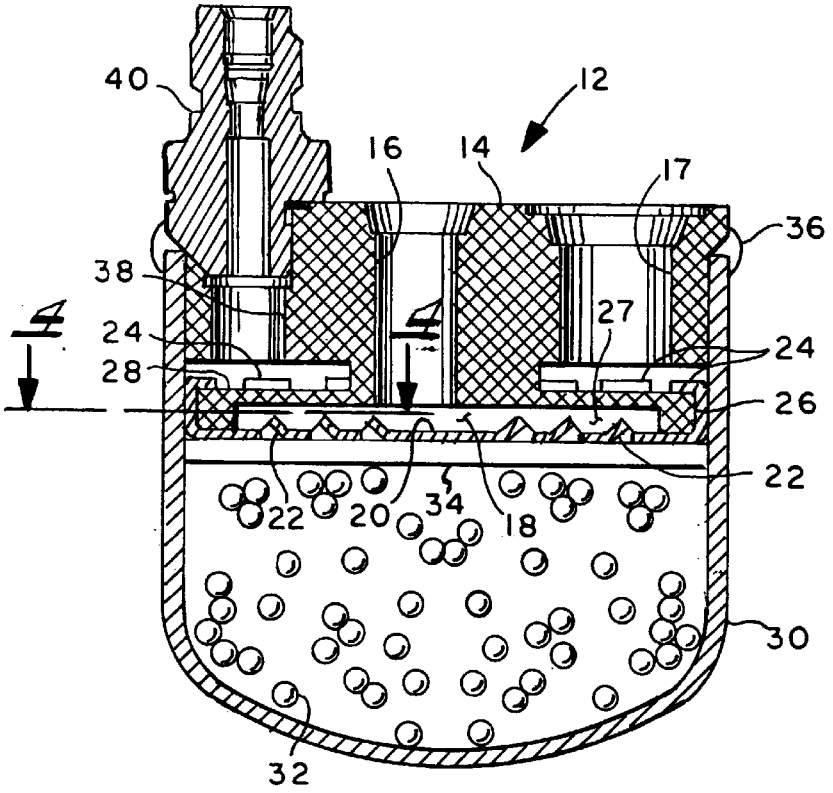
FIG. 2 is a cross-section of the filter/drier assembly of the present invention.

Referring to FIG. 2, the filter/drier of the present invention is indicated generally at 12 and comprises a relatively thick header 14 having formed therein an inlet passage 16 and an enlarged portion thereof forming a plenum 18 and which is closed on the lower end thereof by a baffle 20 which is attached to the header 14 and forms therewith a subassembly. Header 14 also has formed therein an outlet passage 17. Baffle 20 has a plurality of louvered slits denoted by reference numeral 22 formed therein which permit refrigerant flowing inlet passage 16 and plenum 18 to discharge across the baffle 20.

Figure 3:
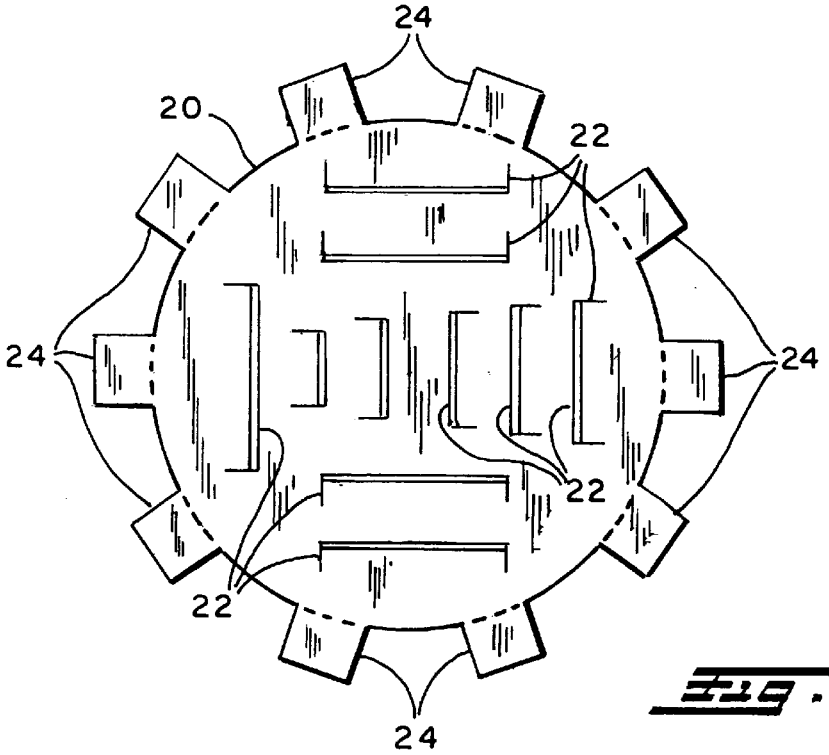
FIG. 3 is a detailed view of the baffle plate of the embodiment of FIG. 2; and, FIG. 4 is a portion of a section view taken along section indicating lines 4—4 of FIG. 2.

Referring to FIG. 3, the baffle 20 is shown in the preferred manner of construction as comprising a relatively thin plate having a plurality of louvers 22 stamped therein for forming inlet flow passages. A plurality of circumferentially spaced outwardly extending tabs or projections 24 are formed about the periphery of the plate, which tabs are, upon assembly of the baffle 20 to header 14, deformed over a flange 26 formed in the header by an annular groove 28 formed therein. The baffle plate 20 is shown in FIG. 3 in the configuration prior to deformation of the tabs 24 which occurs along the dashed lines shown in FIG. 3. The tabs 22 are illustrated in the deformed position in FIG. 2.

Figure 1:
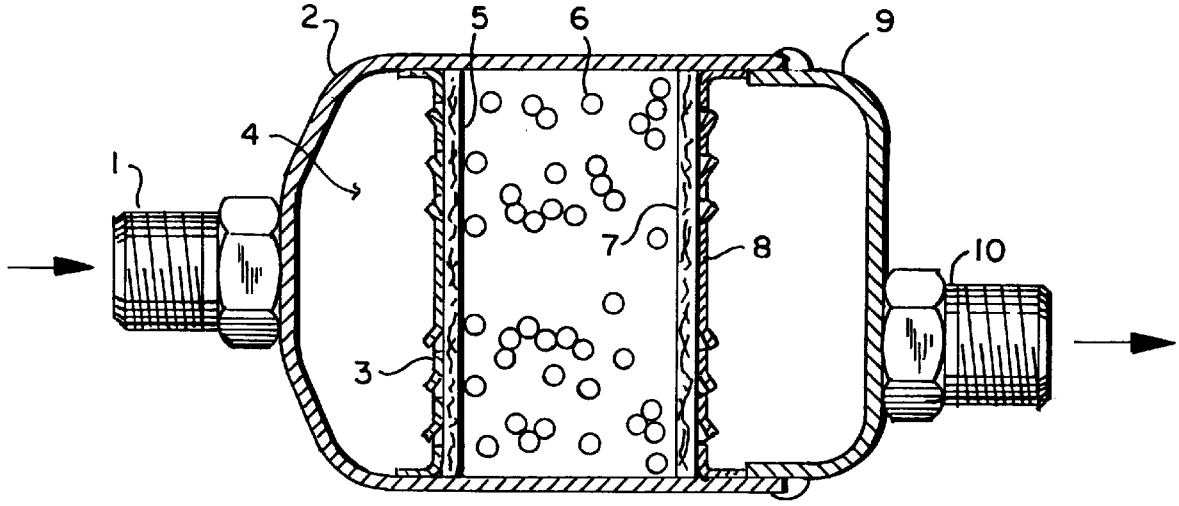
FIG. 1 PRIOR ART
FIG. 1 is a cross-section of a prior art filter/drier.
Figure 4:
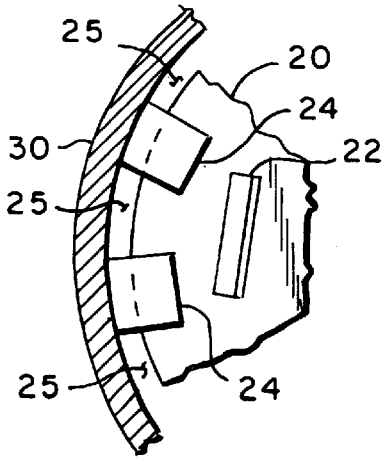

Referring to FIG. 4 the peripheral spaces between the tabs 24 define a plurality of circumferentially spaced passages 25 which disperse and exclusively direct discharge flow around header flange 26 to an annular collector space formed by a groove 28 in the header 14. Collector 27 communicates with outlet port 17.

A cup-shaped shell 30 having a relatively thin-wall configuration is provided with desiccant material 32 therein, preferably in granular form, and a layer 24 of fibrous filter material is packed thereover to retain the desiccant in the shell. The desiccant is then assembled over the subassembly of the header in the baffle and the shell is sealingly attached to the header by any suitable expedient, as for example, circumferential weldment as denoted by reference numeral 36.

An advantage of the construction of the embodiment of FIG. 2 over the prior art is that the weldment sealing the desiccant chamber is performed on the relatively heavy mass of the header which absorbs the heat of weldment and permits more convenient fixturing thereby facilitating weldment.

If desired, an auxiliary fill port 38 is provided in the header having a charge valve fitting 40 attached thereto to permit convenient access for rapid discharge or filling of refrigerant into the system. Fill port 38 communicates with collector 27.

The present invention thus provides a compact filter/drier for a refrigerant system which is easy to assemble and low in manufacturing costs.

Although the invention has hereinabove been described with respect to the illustrated embodiments, it will be understood that the invention is capable of modification and variation and is limited only by the following claims:

1. A filter/drier assembly for receiving and discharging a flow of refrigerant comprising:

(a) a header having an inlet passage defining a plenum an outlet passage therethrough;

(b) a baffle disposed for baffling flow from said plenum wherein said baffle is attached to said header thereby forming a sub-assembly;

(c) a container shell attached to said sub-assembly and defining therewith a fluid pressure sealing chamber communicating with said inlet plenum and said outlet passage; and, (d) desiccant material disposed in said chamber.

2. The assembly defined in claim 1, wherein said baffle is operative to define a plurality of passages dispersing and exclusively directing flow about said header to said outlet port.

3. The assembly defined in claim 1, wherein said baffle is attached to said header by portions thereof deformed over said header.

4. The assembly defined in claim 1, wherein said baffle is attached to said header by deforming thereover portions of said baffle, said portions defining therebetween a plurality of spaced passages exclusively dispersing flow to said outlet port.

5. The assembly defined in claim 1, wherein said baffle comprises a perforated plate having a plurality of tabs thereon deformed over said header for attachment thereto and defining therebetween a plurality of passages exclusively dispersing flow to said outlet port.

6. The assembly defined in claim 1, wherein said outlet passage includes a plenum and an auxiliary port in said plenum with a charge valve provided therein.

7. The assembly defined in claim 1, wherein said baffle comprises a louvered plate.

8. The assembly defined in claim 1, further comprising a filter disposed adjacent said baffle.

9. The assembly defined in claim 1, further comprising a layer of fibrous filter material disposed adjacent said baffle.

10. A method of making a fluid/filter drier assembly comprising:

(a) forming a header with an inlet passage defining a plenum and an outlet passage;

(b) disposing a baffle over said plenum and attaching said baffle to said header and forming a sub-assembly of said header, baffle and plenum; and, (c) disposing desiccant in a shell and attaching said shell to said sub-assembly and forming a sealed desiccant chamber.

11. The method defined in claim 10, wherein said step of attaching said baffle to said header includes deforming portions of said baffle over portions of said header.

12. The method defined in claim 10, wherein said step of attaching said baffle and attaching said shell includes forming dispersion passages and directing flow exclusively therethrough from said chamber to said outlet passage.

13. The method defined in claim 10, further comprising disposing a layer of filter material intermediate said desiccant and said baffle.

14. The method defined in claim 10, wherein said step of disposing and attaching a baffle includes louvering a plate and deforming marginal portions of said plate over said header.

* * * * *